US007520825B2

(12) United States Patent
Justice

(10) Patent No.: US 7,520,825 B2
(45) Date of Patent: Apr. 21, 2009

(54) METHODS AND APPARATUS FOR GOLF SHORT GAME TRAINING

(76) Inventor: Izzy Justice, 20706 Bethelwood La., Cornelius, NC (US) 28031

( * ) Notice: Subject to any disclaimer, the term of this patent is extended or adjusted under 35 U.S.C. 154(b) by 0 days.

(21) Appl. No.: 11/525,882

(22) Filed: Sep. 22, 2006

(65) Prior Publication Data

US 2007/0078022 A1 Apr. 5, 2007

Related U.S. Application Data

(60) Provisional application No. 60/723,120, filed on Oct. 3, 2005.

(51) Int. Cl.
*A63B 69/36* (2006.01)

(52) U.S. Cl. ..... 473/409; 473/170; 473/172; 473/195

(58) Field of Classification Search ..... 473/168–170, 473/172, 190–197
See application file for complete search history.

(56) References Cited

U.S. PATENT DOCUMENTS 1,540,350 A * 6/1925 Longenecker ..... 473/158
4,395,042 A * 7/1983 Boswell ..... 473/195
4,655,460 A * 4/1987 Hambright ..... 473/143
4,750,744 A * 6/1988 Michalec ..... 473/195
5,655,972 A * 8/1997 Heitzman ..... 473/172
5,779,567 A 7/1998 Durso
6,059,672 A 5/2000 Zeiner-Gundersen
6,083,114 A 7/2000 Bailey
6,241,621 B1 * 6/2001 Maher ..... 473/185
6,884,178 B1 * 4/2005 Frost ..... 473/150
6,905,418 B2 6/2005 Rhee
7,066,824 B2 * 6/2006 Wenzler ..... 473/197
2003/0060300 A1 * 3/2003 Morin ..... 473/196
2004/0018884 A1 * 1/2004 Kaplan ..... 473/195
2007/0238540 A1 * 10/2007 Lin ..... 473/172

* cited by examiner

*Primary Examiner*—Mark S Graham
(74) *Attorney, Agent, or Firm*—Myers Bigel Sibley & Sajovec, P.A.

(57) ABSTRACT

A method for training for improving a user's play of a golf short game by providing first and second trajectory targets at different heights and with first and second visual attributes, and providing first and second distance targets with the first and second attributes respectively. A first golf shot is hit through the first trajectory target at the first height at a first trajectory. A second golf shot is hit through the second trajectory target at the second height with a second trajectory. The user associates the first attribute with the first trajectory and the second attribute with the second trajectory. The user then attempts to hit a third shot to the first distance target having the first attribute using the first trajectory and a fourth shot to the second distance target having the second attribute using the second trajectory.

16 Claims, 2 Drawing Sheets

METHODS AND APPARATUS FOR GOLF SHORT GAME TRAINING

RELATED APPLICATION(S)

This application claims the benefit of and priority from U.S. Provisional patent application Ser. No. 60/723,120, filed Oct. 3, 2005.

FIELD OF THE INVENTION

The present invention relates to golf and, more particularly, to methods and apparatus for golf training.

BACKGROUND OF THE INVENTION

The game of golf generally includes a long game and a short game. The short game is generally defined as golf shots taken from 100 yards or less from the pin. Typically, the short game comprises puts on the putting green and shots taken from around the putting green such as lob shots, chipping, pitching and bunker play. While improvements in a player's short game can significantly lower the player's scores, training for the short game is often neglected.

SUMMARY OF THE INVENTION

According to embodiments of the present invention, a method for training for improving a user's play of a golf short game includes, in combination, the steps of: providing first and second trajectory targets such that the first trajectory target is located at a first height and the second trajectory target is located at a second height that is higher than the first height, wherein the first trajectory target has a first visual attribute and the second trajectory target has a second visual attribute different from the first visual attribute; hitting a first golf shot to attempt to hit a golf ball into the first trajectory target at the first height, whereby the first visual attribute is associated by the user with a first trajectory; hitting a second golf shot to attempt to hit a golf ball into the second trajectory target at the second height, whereby the second visual attribute is associated by the user with a second trajectory; providing first and second distance targets on a ground surface, wherein the first distance target has the first visual attribute and the second target has the second visual attribute; hitting a third golf shot to attempt to hit a golf ball into the first distance target using the first trajectory; and hitting a fourth golf shot to attempt to hit a golf ball into the second distance target using the second trajectory.

According to some embodiments, the first visual attribute is a first color and the second visual attribute is a second color different from the first color.

According to some embodiments, the method further includes: providing a third trajectory target such that the third trajectory target is located at a third height that is higher than the second height, wherein the third trajectory target has a third visual attribute different from the first and second visual attributes; hitting a fifth golf shot to attempt to hit a golf ball into the third trajectory target at the third height, whereby the third visual attribute is associated by the user with a third trajectory; providing a third distance target on the ground surface, wherein the third distance target has the third visual attribute; and hitting a sixth golf shot to attempt to hit a golf ball into the third distance target using the third trajectory.

According to embodiments of the present invention, a training kit for improving a user's play of a golf short game includes, in combination, first and second trajectory targets, first and second distance targets and instructions. The first and second trajectory targets are relatively configured and/or configurable such that the first trajectory target is located at a first height and the second trajectory target is located at a second height that is higher than the first height. The first trajectory target has a first visual attribute and the second trajectory target has a second visual attribute different from the first visual attribute. The first and second distance targets are mounted and/or mountable on a ground surface. The first distance target has the first visual attribute and the second target has the second visual attribute. The instructions direct the user to: hit a first golf shot to attempt to hit a golf ball into the first trajectory target at the first height, whereby the first visual attribute is associated by the user with a first trajectory; hit a second golf shot to attempt to hit a golf ball into the second trajectory target at the second height, whereby the second visual attribute is associated by the user with a second trajectory; hit a third golf shot to attempt to hit a golf ball into the first distance target using the first trajectory; and hit a fourth golf shot to attempt to hit a golf ball into the second distance target using the second trajectory.

According to some embodiments, the first visual attribute is a first color and the second visual attribute is a second color different from the first color.

According to some embodiments, the kit further includes a third trajectory target and a third distance target. The third trajectory target is configured and/or configurable such that the third trajectory target is located at a third height that is higher than the second height. The third trajectory target has a third visual attribute different from the first and second visual attributes. The third distance target is mounted and/or mountable on the ground surface. The third distance target has the third visual attribute. The instructions direct the user to: hit a fifth golf shot to attempt to hit a golf ball into the third trajectory target at the third height, whereby the third visual attribute is associated by the user with a third trajectory; and hit a sixth golf shot to attempt to hit a golf ball into the third distance target using the third trajectory.

Further features, advantages and details of the present invention will be appreciated by those of ordinary skill in the art from a reading of the figures and the detailed description of the embodiments that follow, such description being merely illustrative of the present invention.

DETAILED DESCRIPTION OF EMBODIMENTS OF THE INVENTION

Figure 1:
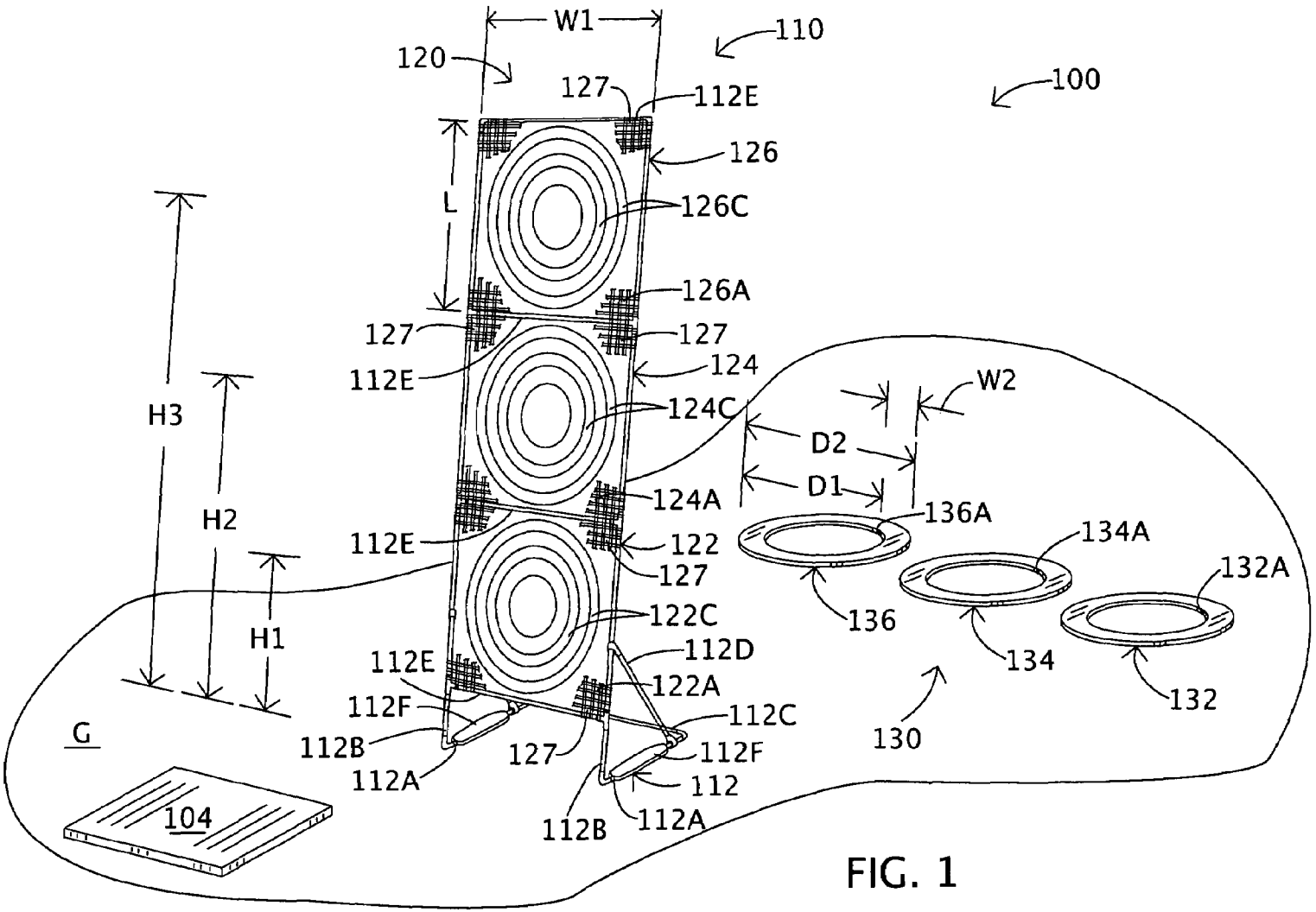
FIG. 1 is a perspective view of a short game golf training system or kit according to embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Well-known functions or constructions may not be described in detail for brevity and/or clarity. Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

As used in herein, "golf short game" refers to golf shots taken from about 100 yards or less from the pin of a selected golf course hole. That is, a short game shot is a golf shot hit from about 100 yards or less from a selected golf hole with the intent of hitting the golf ball into or adjacent the hole. Golf short game shots may include lob shots, chipping, pitching and/or bunker shots hit from around a golf green, as well as putting.

As used herein and commonly understood, "hitting a golf shot" means swinging a golf club to strike a golf ball with a head of the golf club to drive or displace the golf ball. A player typically hits a golf shot in an attempt to displace the golf ball a selected distance, in a selected direction, at a selected angle and with a selected ball flight trajectory.

As used herein, a "pitch point" refers to the location on the ground where a golf ball in flight from a golf shot first lands. As used herein, a "release" is the bounce and/or roll of a golf ball from the pitch point.

In accordance with embodiments of the present invention, golf training methods and apparatus are provided to aid or assist golfers in improving their short game. As will be further appreciated from the disclosure herein, methods and apparatus of the present invention may be used to develop or enhance a golfer's skills in hitting golf shots of different selected trajectories, landing a struck golf ball at a desired distance from the ball's strike position, and/or hitting a golf ball both with a selected trajectory and a selected distance. A golfer may employ methods and apparatus of the present invention to learn ball release behavior and improve shot selection.

With reference to FIG. 1, a short game golf training system or kit 100 according to embodiments of the present invention is shown therein. The kit 100 includes a hitting mat 104, a trajectory target assembly 110, and a set 130 of distance targets. Each of these components will be discussed in more detail below.

The hitting mat 104 may be of any suitable construction. For example, the mat 104 may be formed of AstroTurf™ carpet or the like. The mat 104 may be omitted, in which case a player may hit practice shots directly from the ground or another surface.

The target assembly 110 includes a frame assembly 112 and a set 120 of three vertically stacked or aligned trajectory targets 122, 124 and 126.

The assembly 112 includes base legs 112A, uprights 112B, corner braces 112C, a lower cross brace 112D, and upper cross braces 112E. The frame 112 may be provided in the form shown, or may be provided as a ready-to-assemble or knockdown assembly. According to some embodiments, the frame 112 consists of a plurality of rods or other members that can be linked, fitted, fastened and/or secured to one another to assemble the frame 112 and thereafter disassembled and reassembled. According to some embodiments, the rods are interconnected by elastic shock cords running through the rods. For example, each of the uprights 112B may be formed of multiple rod sections that are releasably interconnected by a shock cord. The frame 112 may be formed of any suitable material. For example, the frame 112 may be formed of a polymeric or metal material such as fiberglass and/or aluminum. A device or devices may be provided to secure or stabilize the frame 112 with respect to the ground G. According to some embodiments, weight bags 112F (e.g., filled with sand or bird shot) are mounted on the base rods 112A and/or stakes or the like may be mounted on the frame 112 and driven into the ground G. Other configurations or constructions of the frame 112 maybe used.

According to some embodiments and as illustrated, the trajectory targets 122, 124, 126 of the target set 120 are joined end-to-end to form a strip including the targets 122, 124, 126 as sections thereof in the series. Each target 122, 124, 126 extends widthwise and heightwise between the uprights 112B. The targets 122, 124, 126 may be secured to the uprights 112B by any suitable technique. According to some embodiments, the targets 122, 124, 126 each include a body panel portion 122A, 124A, 126A. Sleeve portions 127 adjoin and extend along the side edges and end edges of the body panel portions 122A, 124A, 126A. The uprights 112B and the cross members 112E extend through the sleeve portions 127 to support and retain the targets 122, 124, 126. According to some embodiments, the uprights 112B can be disassembled at/or adjacent the cross members 112E so that the three targets 122, 124, 126 can be folded over on top of one another for storage or transport.

The targets 122, 124, 126 may be formed of any suitable construction. According to some embodiments and as shown, the targets 122, 124, 126 are formed of netting. According to some embodiments, at least about 50% of the area of the netting is open to permit light and wind to pass therethrough. The targets 122, 124, 126 may be formed of any suitable material, such as a polymeric or cotton netting material.

Each of the targets 122, 124, 126 has a respective visual attribute that may be readily observed and registered by the player P. The visual attribute of each target 122, 124, 126 is different from the visual attributes of the other targets 122, 124, 126. According to some embodiments, the visual attributes are respective different colors. According to some embodiments, the visual attribute of the target 122 is the color green, the visual attribute of the target 124 is the color yellow, and the visual attribute of the target 126 is the color red. The colors may be provided on the targets 122, 124, 126 by any suitable technique. According to some embodiments, the respective colors are painted or printed onto the targets 122, 124, 126 and/or dyed into the netting thereof. Indicias such as concentric ring patterns 122C, 124C, 126C may be provided on the front faces of the targets 122, 124, 126 to define bullseyes or the like. In accordance with some embodiments, the substantial entirety of the front face of the body portion 122A is green, the substantial entirety of the front face of the body portion 124A is yellow, and the substantial entirety of the front face of the body portion 126A is red, except for the indicias 122C, 124C, 126C.

According to some embodiments, each of the targets 122, 124, 126 has a width W1 of between about 16 and 18 inches. According to some embodiments, each of the targets 122, 124, 126 has a length L of between about 16 and 18 inches. According to some embodiments, the vertical midpoint of the target 122 is located at a height H1 of between about 18 and 22 inches from the ground G. According to some embodiments, the vertical midpoint of the target 124 is located at a height H2 of the between about 36 and 40 inches from the ground G. According to some embodiments, the vertical midpoint of the target 126 is located at a height H3 of between about 54 and 58 inches from the ground G.

The set 130 of distance targets includes distance targets 132, 134, and 136. According to some embodiments and as illustrated, the distance targets 132, 134, 136 are circular rings each defining a respective inner or target opening 132A, 134A, 136A. However, the targets 132, 134, 136 may be otherwise constructed or shaped.

Each of the targets 132, 134, 136 has the visual attribute of a corresponding one of the targets 122, 124, 126. More particularly, the target 132 has the visual attribute of the target 122, the target 134 has the visual attribute of the target 124, and the target 136 has the visual attribute of the target 126. According to some embodiments, the targets 132, 134, and 136 are the same colors as the targets 122, 124, and 126, respectively. According to some embodiments, the targets 122 and 132 are each colored green, the targets 124 and 134 are each colored yellow, and the targets 126 and 136 are each colored red.

The distance targets 132, 134, 136 may be formed of any suitable material. According to some embodiments, the targets 132, 134, 136 are formed of a polymeric material. The visual attributes may be provided on the targets 132, 134, 136 in any suitable manner. According to some embodiments, the visual attributes (e.g., colors) are painted on or dyed into the targets 132, 134, 136.

According to some embodiments, each target opening 132A, 134A, 136A has a diameter D1 of at least about 6 inches. According to some embodiments, the diameter D1 is between about 6 and 9 inches. According to some embodiments, each of the targets 132, 134, 136 has an outer diameter D2 of at least about 10 inches. According to some embodiments, the diameter D2 is between about 10 and 13 inches. According to some embodiments, each of the targets 132, 134, 136 has a width W2 between the target opening and the outer periphery of the target of at least about 1 inch. According to some embodiments, the width W2 is between about 1 and 3 inches. According to some embodiments, the thickness of each of the targets 132, 134, 136 is between about 0.1 and 0.15 inches so that the ball can easily roll over the target.

Figure 2:
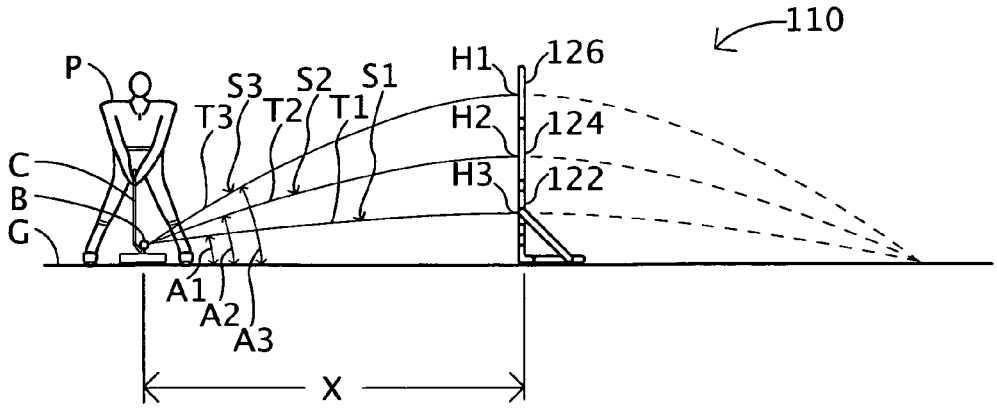
FIG. 2 is a schematic side view illustrating a player hitting golf shots into a trajectory target assembly 110 of the golf training kit of FIG. 1 in accordance with embodiments of the present invention.
Figure 3A:
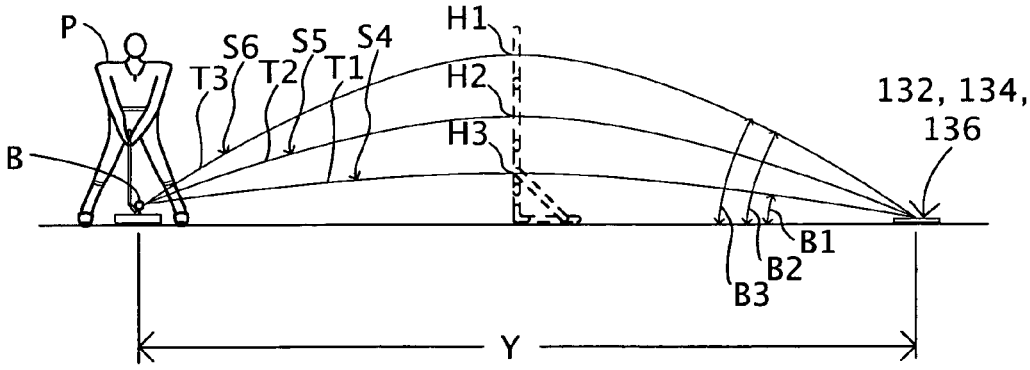
FIGS. 3A and 3B are a schematic side and top views, respectively of the player of FIG. 2 hitting golf shots into a set of distance targets forming a part of the golf training kit of FIG. 1 in accordance with embodiments of the present invention.
Figure 3B:
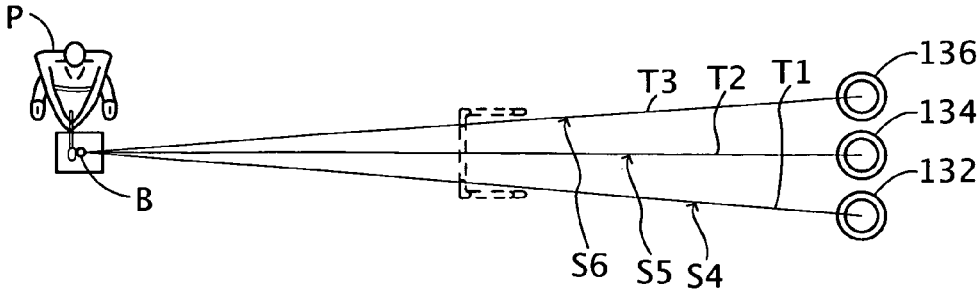

With reference to FIGS. 2, 3A and 3B, the golf training kit 100 can be used in the following manner in accordance with methods of the present invention.

The target assembly 110 is placed a selected distance X from the ball B and the player P such that the trajectory targets 122, 124, 126 face the player P. The ball B may be placed on the mat 104.

The player P swings a golf club C and strikes the ball B to hit a first golf shot S1. In hitting the first golf shot S1, the player P attempts to direct the ball B into the target 122 along a first trajectory T1 such that the ball B strikes the target 122 at the apex of the trajectory T1 at the height H1. The player P thereafter hits a second golf shot S2 in an attempt to direct the ball B into the target 124 along a second trajectory T2 such that the ball B strikes the target 124 at the apex of the trajectory T2 at the height H2. The player P thereafter hits a third golf shot S3 in an attempt to direct the ball B into the target 126 along a third trajectory T3 such that the ball strikes the target 126 at the apex of the trajectory T3 at the height H3. The player P may hit the first, second and third golf shots S1, S2, S3 in a different order than described above. Each golf shot may be hit with the same ball B or different balls. The player P may hit multiple first, second and third golf shots to practice each golf shot in repetition.

According to some embodiments, the distance X is between about 5 and 20 feet. According to some embodiments, the trajectory T1 of the first golf shot S1 forms an angle A1 of between about 10 and 20 degrees with the ground G. According to some embodiments, the trajectory T2 of the second golf shot S2 forms an angle A2 of between about 20 and 40 degrees with the ground G. According to some embodiments, the trajectory T3 of the third golf shot S3 forms an angle A3 of between about 40 and 75 degrees with the ground.

The foregoing exercise serves to train the player in ball trajectory. The shot required to hit the ball B into the first target 122 along the trajectory T1 may be a bump and run or basic chip shot. The shot required to hit the ball B into the second target 124 along the trajectory T3 may be a basic pitch shot. The shot required to hit the ball B into the target 126 along the trajectory T3 may be a lob shot. By practicing these shots in the manner described, the player P may learn to control the height and the trajectory of the ball and may experiment with different clubs and address setups. The player P also learns to match each trajectory T1, T2, T3 with the visual indicia (e.g., respective colors) of the corresponding targets 122, 124, 126.

With reference to FIGS. 3A and 3B, the player P thereafter places the distance targets 132, 134, 136 a selected distance Y from the strike position of the ball B. The distance Y is approximately twice the distance X so that the distance targets 132, 134, 136 are positioned at the distance where the first, second and third shots S1, S2, S3 would have landed had they not been blocked by the trajectory targets 122, 124, 126. The target assembly 110 is not positioned in the path between the player P and the targets 132, 134, 136, but is shown in FIGS. 3A and 3B in dashed lines for reference in describing embodiments of the invention. According to some embodiments, the targets 132, 134, 136 are each placed the same distance Y from the player P.

The player P then hits a fourth golf shot S4 attempting to the cause the ball B to fly along the first trajectory T1 and first land in the target opening 132A of the target 132. The player hits a fifth golf shot S5 attempting to cause the ball B to fly along the second trajectory T2 and land in the target opening 134A of the target 134. The player hits a sixth golf shot S6 attempting to cause the ball B to fly along the third trajectory T3 and land in the target opening 136A of the target 136. Each golf shot S4, S5, S6 (if hit as intended) will land in its respective target at a respective angle B1, B2, B3 with respect to the ground G that is approximately the same as the angle A1, A2, A3 for the attempted trajectory T1, T2, T3.

For each golf shot, the ball B may continue to bounce or roll (not illustrated) after landing in the target 132, 134, 136. The player P may hit the fourth, fifth and sixth golf shots S4, S5, S6 in a different order than outlined above. Each golf shot may be hit with the same ball B or different balls. The player P may hit multiple fourth, fifth and sixth golf shots to practice each golf shot in repetition.

The player thereby attempts to hit the ball B into the colored rings 132, 134, 136 with shots or shot types matching those hit into the targets 122, 124, 126. For example, if the first shot S1 along the trajectory T1 was a bump and run shot, the player P attempts to hit the fourth shot S4 as a bump and run shot into the target 132. Likewise, if the second shot S2 along the trajectory T2 was a pitch shot, the player attempts to hit the fifth shot S5 as a pitch shot into the target 134, and if the third shot S3 along the trajectory T3 was a lob shot, the player attempts to hit the sixth shot S6 as a lob shot into the target 136.

The player P may then attempt to hit the ball B into the distance targets 132, 134, 136 from different distances away from the player. For each target 132, 134, 136, the player P attempts to hit the ball B into the target 132, 134, 136 using a trajectory that corresponds to the trajectory T1, T2, T3 that was used to hit into that distance target in the procedure described above with reference to FIGS. 3A and 3B. More particularly, the player P attempts to hit the ball B into the distance target 132 such that it lands in the distance target 132 at the angle B1, attempts to hit the ball B into the distance target 134 such that it lands in the distance target 134 at the angle B2, and attempts to hit the ball B into the distance target 136 such that it lands in the distance target 136 at the angle B3.

The foregoing exercise serves to train the player in distance control. The foregoing exercise in combination with the trajectory target exercise further serves to train the player in shot distance control in combination with control and/or selection of shot trajectory, angle or type.

The learned distance control may include distance to ball landing as well as release or roll distance. In practicing hitting the first, second and third golf shots S1, S2, S3 into the targets 122, 124 and 126, the player learns to match or associate the respective trajectories T1, T2, T3 with the respective colors (or other visual attributes) of the targets 122, 124, 126. Moreover, the player learns to match or associate the launch angles A1, A2, A3 and the landing angles B1, B2, B3 of the respective trajectories T1, T2, T3 with the respective colors (or other visual attributes) of the targets 122, 124, 126. The player further observes the behavior of the ball upon landing at the respective angles B1, B2, B3 so that the player can learn how a ball will release for each landing angle or type of shot. In this way, the player may learn not only how to hit and predict the release of specific trajectories T1, T2, T3 with visual attribute association, but may also extrapolate this learning and association to trajectories having the same angles as the trajectories T1, T2, T3 but different distances and peak heights.

It will be appreciated that, in accordance with some embodiments, the distance targets 132, 134, 136 do not simulate a golf hole, but rather simulate a selected pitch (first landing) point. A given golf shot will release from its pitch point a distance and direction dependent on the angle of incidence with the ground. Thus, the angle and trajectory training of the methods and apparatus of the present invention may assist the player in selecting and executing, for a given ball lie, the pitch location and angle that provides the ball with the best chance of releasing to the hole.

The green, yellow and red colors may be preferred for the relatively increasing trajectories T1, T2, T3 because these colors are commonly pre-associated with safe (green), caution (yellow), and stop or danger (red), which properly correspond to the respective difficulties or risks associated with the types of shots being hit into the targets 122, 124, 126 of those colors. The color matching may serve to induce or trigger muscle memory for each type of shot or trajectory. The methods and apparatus according to embodiments of the present invention may serve to combine desired skills (i.e., each type or trajectory of shot) with a trigger stimulant (i.e., the associated color) so that the player P can rely on the trigger to induce the skill needed. The player P can learn to combine colors and imagery with short game shot making creativity. The trajectory targets 122, 124, 126 and the matching distance targets 132, 134, 136 and methods of the present invention can train the player P to think about the type of shot that the player P should hit given the conditions of a ball position relative to a hole. When confronted with the need for a particular shot on the golf course, the player can think of the color he has associated with the called for shot using the training kit 100, and then duplicate the skill associated with that color.

The methods and apparatus according to embodiments of the present invention may significantly improve a golfer's game. Shot selection in view of a shot environment can be very important. For example, a ball may lie in a position such that the golfer wishes to hit the ball over a bunker between the ball and the green, but wants the ball to stop short after it lands so that the ball does not roll past the green or hole. In such case, the preferred shot may be a relatively steep angle trajectory lob shot. On the other hand, where there is no such obstacle between the ball and the green, the golfer may prefer to hit a low angle trajectory bump and run shot because such a shot is easier to hit (i.e., can be hit more consistently or predictably or with lower harm from error). By training using methods and apparatus of the present invention, the golfer may be better familiarized with how the ball will release after it lands at its pitch point for different possible shot types or angles, thereby improving the player's ability to select the best type or angle of shot for a given situation. Moreover, once the shot type is selected, the player can visualize the shot or desired pitch or landing point as having the visual attribute (e.g., color) of the corresponding training target and draw on the muscle memory associated with that visual attribute. For example, if a lob shot is selected, the player can visualize the selected landing point as red.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A method of training for improving a user's play of a golf short game, the method comprising, in combination, the steps of:

providing first and second trajectory targets such that the first trajectory target is located at a first height and the second trajectory target is located at a second height that is higher than the first height, wherein the first trajectory target has a first visual attribute and the second trajectory target has a second visual attribute different from the first visual attribute;

hitting a first golf shot to attempt to hit a golf ball into the first trajectory target at the first height, whereby the first visual attribute is associated by the user with a first trajectory;

hitting a second golf shot to attempt to hit a golf ball into the second trajectory target at the second height, whereby the second visual attribute is associated by the user with a second trajectory;

providing first and second distance targets on a ground surface, wherein the first distance target has the first visual attribute and the second target has the second visual attribute;

hitting a third golf shot to attempt to hit a golf ball into the first distance target using the first trajectory, wherein the first trajectory target is not in the path of the third golf shot; and hitting a fourth golf shot to attempt to hit a golf ball into the second distance target using the second trajectory, wherein the second trajectory target is not in the path of the fourth golf shot.

2. The method of claim 1 wherein the first visual attribute is a first color and the second visual attribute is a second color different from the first color.

3. The method of claim 1 including:

providing a third trajectory target such that the third trajectory target is located at a third height that is higher than the second height, wherein the third trajectory target has a third visual attribute different from the first and second visual attributes;

hitting a fifth golf shot to attempt to hit a golf ball into the third trajectory target at the third height, whereby the third visual attribute is associated by the user with a third trajectory;

providing a third distance target on the ground surface, wherein the third distance target has the third visual attribute; and hitting a sixth golf shot to attempt to hit a golf ball into the third distance target using the third trajectory.

4. The method of claim 3 wherein the first visual attribute is a first color, the second visual attribute is a second color different from the first color, and the third visual attribute is a third color different from the first and second colors.

5. The method of claim 4 wherein the first, second and third colors are green, yellow and red, respectively.

6. The method of claim 3 wherein the first, second and third trajectory targets are each positioned at the first, second and third heights, respectively, during each of the steps of hitting the first, second and fifth golf shots.

7. The method of claim 6 wherein the first, second and third trajectory targets are each mounted on a shared frame.

8. The method of claim 7 wherein the first, second and third trajectory targets are vertically aligned on the shared frame.

9. The method of claim 1 wherein each of the first and second distance targets is ring-shaped.

10. The method of claim 9 wherein each of the ring shaped first and second distance targets defines a target opening having a diameter of at least about 6 inches.

11. The method of claim 1 wherein the steps of hitting the first and second golf shots include hitting the first and second golf shots from a distance of between about 5 and 20 feet from the first and second trajectory targets.

12. The method of claim 1 wherein the step of hitting the first golf shot includes hitting the first golf shot at an angle with respect to the ground of between about 10 and 20 degrees, and the step of hitting the second golf shot includes hitting the second golf shot at an angle with respect to the ground of between about 20 and 40 degrees.

13. A method of training for improving a user's play of a golf short game, the method comprising, in combination, the steps of:

providing first and second trajectory targets such that the first trajectory target is located at a first height and the second trajectory target is located at a second height that is higher than the first height, wherein the first trajectory target has a first visual attribute and the second trajectory target has a second visual attribute different from the first visual attribute;

hitting a first golf shot to attempt to hit a golf ball into the first trajectory target at the first height, whereby the first visual attribute is associated by the user with a first trajectory;

hitting a second golf shot to attempt to hit a golf ball into the second trajectory target at the second height, whereby the second visual attribute is associated by the user with a second trajectory;

providing first and second distance targets on a ground surface and at substantially ground level, wherein the first distance target has the first visual attribute and the second target has the second visual attribute;

hitting a third golf shot to attempt to hit a golf ball into the first distance target using the first trajectory; and hitting a fourth golf shot to attempt to hit a golf ball into the second distance target using the second trajectory.

14. The method of claim 13 wherein placing the first and second distance targets includes providing the first and second targets directly on the ground surface.

15. The method of claim 1 wherein the first and second trajectory targets are vertically aligned.

16. A method of training for improving a user's play of a golf short game, the method comprising, in combination, the steps of:

providing first and second trajectory targets such that the first trajectory target is located at a first height and the second trajectory target is located at a second height that is higher than the first height, wherein the first trajectory target has a first visual attribute and the second trajectory target has a second visual attribute different from the first visual attribute;

hitting a first golf shot to attempt to hit a golf ball into the first trajectory target at the first height, whereby the first visual attribute is associated by the user with a first trajectory;

hitting a second golf shot to attempt to hit a golf ball into the second trajectory target at the second height, whereby the second visual attribute is associated by the user with a second trajectory;

providing first and second distance targets on a ground surface, wherein the first distance target has the first visual attribute and the second target has the second visual attribute;

hitting a third golf shot to attempt to hit a golf ball into the first distance target using the first trajectory; and hitting a fourth golf shot to attempt to hit a golf ball into the second distance target using the second trajectory;

wherein:

the first visual attribute is a first color and the second visual attribute is a second color different from the first color;

the first trajectory target and the first distance target each have the first color thereon and/or therein;

the second trajectory target and the second distance target each have the second color thereon and/or therein;

the first trajectory target is not in the path of the third golf shot;

the second trajectory target is not in the path of the fourth golf shot;

providing the first and second distance targets on a ground surface includes providing the first and second distance targets on the ground surface at substantially ground level; and the first and second trajectory targets are vertically aligned.

* * * * *